US006623229B1

(12) United States Patent
Sansone et al.

(10) Patent No.: US 6,623,229 B1
(45) Date of Patent: Sep. 23, 2003

(54) ENVELOPE THAT IS CONDUCIVE TO PRINTING A FACING IDENTIFICATION MARK WITH AN INFORMATION BASED INDICIA

(75) Inventors: Ronald P. Sansone, Weston, CT (US); Richard A. Bernard, Norwalk, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/516,290

(22) Filed: Mar. 1, 2000

(51) Int. Cl.[7] ..... B42D 15/00

(52) U.S. Cl. ..... 412/1; 283/67; 283/70; 283/116; 229/68.1

(58) Field of Search ..... 229/69, 70, 73, 229/302, 68.1; 283/67, 70, 116, 61, 62; 412/1

(56) References Cited

U.S. PATENT DOCUMENTS

| | | | | | |
|---|---|---|---|---|---|
| 4,754,915 | A | * | 7/1988 | Steidinger | 229/73 |
| 4,919,324 | A | | 4/1990 | Hottle et al. | 229/68 R |
| 5,095,682 | A | * | 3/1992 | Steidinger | 493/216 |
| 5,887,780 | A | * | 3/1999 | Popat et al. | 229/69 |
| D414,511 | S | | 9/1999 | Kara | D19/3 |

* cited by examiner

*Primary Examiner*—Willmon Fridie, Jr.
(74) *Attorney, Agent, or Firm*—Ronald Reichman; Angelo N. Chaclas

(57) ABSTRACT

An envelope that enables personal computer printers to be able to print a Facing Identification Mark (FIM) as part of a Information-Based Indicia (IBI) registered along the top edge of the envelope. The personal computer printers will also be able to print the FIM, IBI, the recipient's address and the sender's address without the glue on the envelope closure flap adhering to the body of the envelope, which would seal or partially seal the envelope, potentially rendering the envelope useless.

5 Claims, 7 Drawing Sheets

ENVELOPE THAT IS CONDUCIVE TO PRINTING A FACING IDENTIFICATION MARK WITH AN INFORMATION BASED INDICIA

FIELD OF THE INVENTION

The invention relates generally to the field of franking machines and more particularly to the printing of postal indicia and facing identification marks on envelopes.

BACKGROUND OF THE INVENTION

Historically, postage meters have been mechanical and electromechanical devices that maintain, through mechanical or "electronic registers" (postal security devices), an account of all postage printed and the remaining balance of prepaid postage, and print postage postmarks (indicia) that are accepted by the postal service as evidence of the prepayment of postage.

Currently, small business mailers may use their desktop computer (personal computer) and printer to apply postage directly onto envelopes or labels while applying an address. The United States Postal Service Engineering Center recently published a notice of proposed specification that may accomplish the foregoing. The title of the specification is "Information-Based Indicia Program Postal Security Device Specification" dated Jun. 13, 1996. The Information-Based Indicia Program specification includes both proposed specifications for the new indicium and proposed specifications for a postal security device (PSD). The proposed Information-Based Indicia (IBI) consists of a two-dimensional bar code containing hundreds of bytes of information about the mail piece and certain human and machine readable information. The indicium includes a digital signature to preclude the forgery of indicia by unauthorized parties. The PSD is a unique security device that provides a cryptographic digital signature to the indicium and performs the function of postage meter registers. The United States Postal Service has also allowed an IBI to be downloaded to a personal computer over the internet.

Current United States Postal Service IBI specifications require a Facing Identification Mark (FIM) to be part of the IBI indicia so that the USPS Advanced Facer Canceller may detect the presence of an IBI mail piece to sort the mail piece properly. In the United States, the FIM is a pattern of vertical bars printed in the upper right portion of the mail piece to the left of the indicia. A FIM pattern is essentially a nine bit code consisting of bars and no bar place holders. The presence of a bar can be considered a binary one ("1") and the absence of a bar is a binary "0". Thus, as currently specified, the United States Postal Service FIM is large, having approximately 20% of the IBI indicia area.

Generally, the software provided to drive personal computer printers does not allow one to print near the top of paper or envelopes. Thus, personal computer printers have difficulty in reliably printing the IBI indicia. The reason for the foregoing is that the FIM, a component of the IBI, is located near the top edge of the envelope, and it is difficult for personal computer printer's software to allow one to print near the top edge of the envelopes. This difficulty may result in a unreadable IBI and the possible loss of the customer's postage.

Another problem with the prior art is that it is difficult for personal computer printers to print an IBI indicia in proper registration to a preprinted FIM.

An additional problem with using personal computer printers to print on an envelope is that such printers have a tendency to cause the glue on the envelope closure flap to adhere to the body of the envelope, thereby sealing or partially sealing the envelope and potentially rendering the envelope useless. Such adhesion is caused by the fact that the closure flap is closed over the body such that the glue contacts the body of the envelope during printing. Heat from the printer causes moisture in the paper to evaporate and moisten the glue which then adheres to the envelope body.

SUMMARY OF THE INVENTION

This invention overcomes the disadvantages of the prior art by providing a envelope that personal computer printers will be able to print a Facing Identification Mark (FIM) as part of an IBI registered along the top edge of the envelope. The personal computer printers will also be able to print the FIM, IBI, the recipient's address and the sender's address without the glue on the envelope closure flap adhering to the body of the envelope, without sealing or partially sealing the envelope which potentially would render the envelope useless.

DETAILED DESCRIPTION OF THE PREFERRED EMBODIMENT

Figure 1:
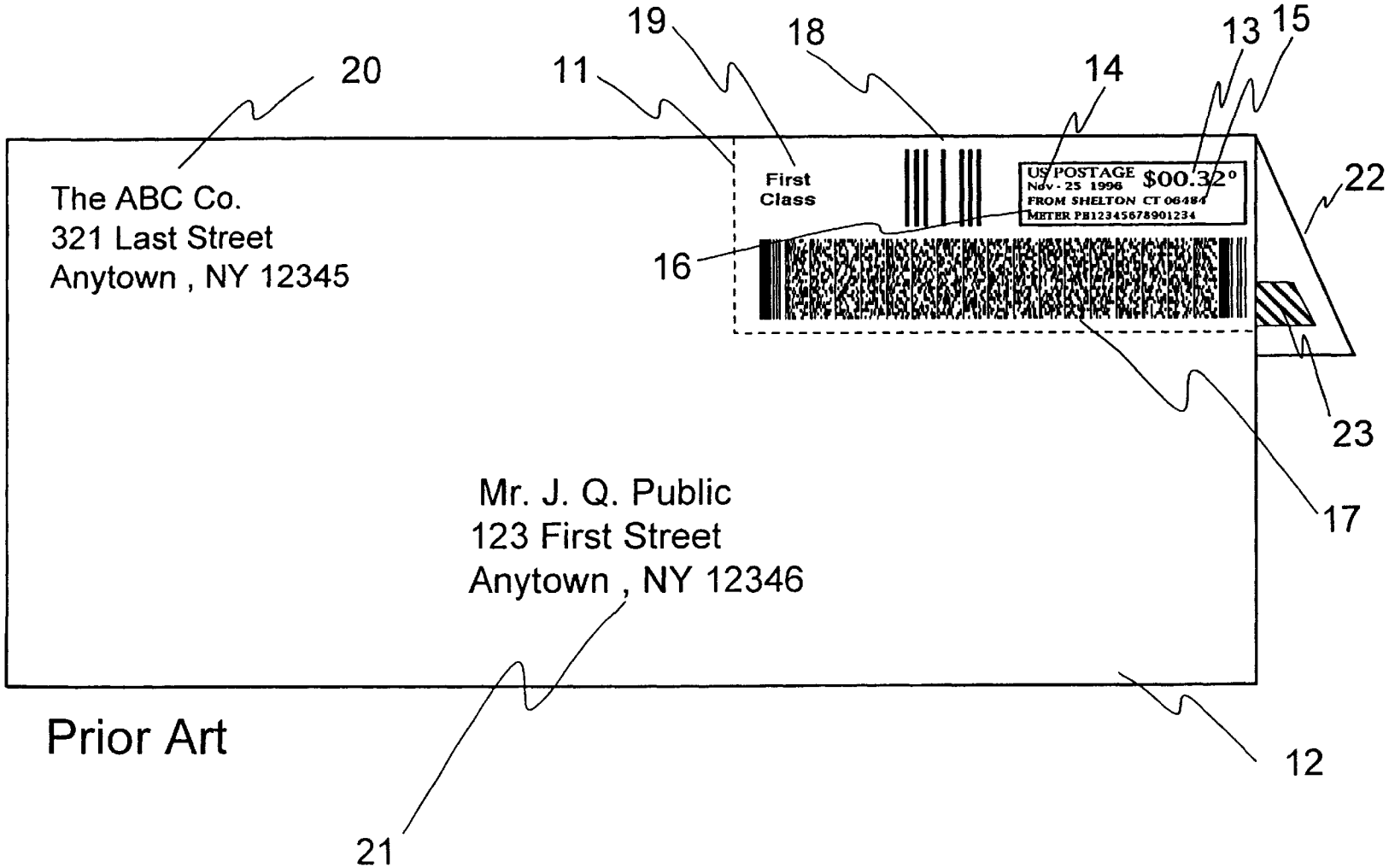
FIG. 1 is a drawing of the front of a prior art addressed envelope with an IBI indicia.

Referring now to the drawings in detail, and more particularly to FIG. 1, the reference character 11 represents a USPS IBI that was printed on the front of a prior art envelope 12 by a computer printer (not shown). The postal indicia 11 contains a dollar amount 13, the date 14 that the postal indicia was affixed to the mail piece, the place the mail piece was mailed from 15, the postal meter serial number 16, a 2-D encrypted bar code 17, a FIM 18 and a indication 19 of the class of envelope 12. Envelope 12 is going to be sent by sender 20 to the person and place indicated in address field 21. Envelope 12 has a flap 22 that contains a strip of water activated glue 23.

Figure 2A:
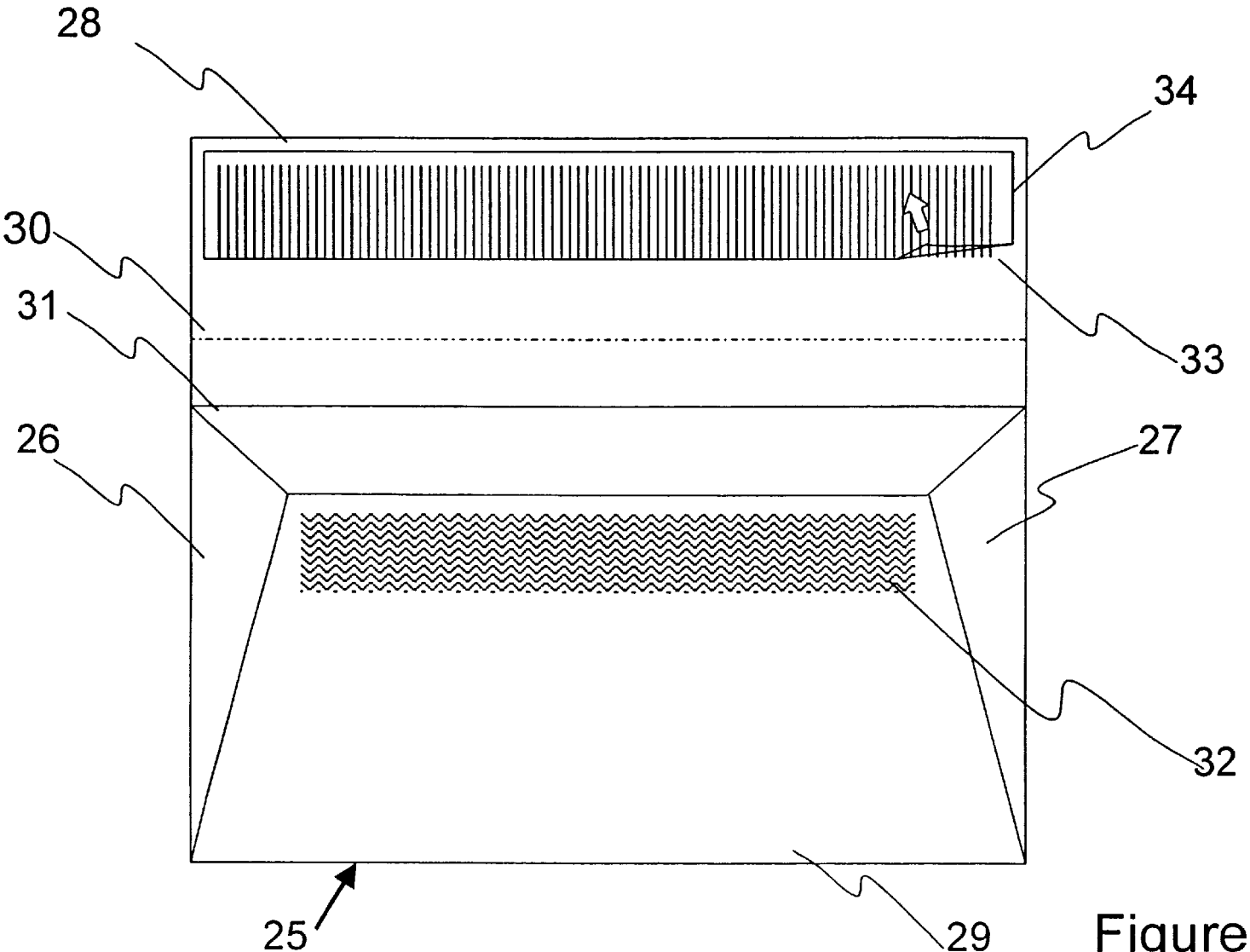
FIG. 2A is a drawing of the back of the envelope 25 of this invention in an open configuration before the IBI indicia, recipient's and sender's addresses are printed.

FIG. 2A is a drawing of the back of the envelope 25 of this invention in a open configuration before the IBI indicia, recipient's and sender's addresses are printed. Envelope 25 comprises: side panels 26 and 27, an envelope flap 28, a body 29; and a throat 40. Flap 28 has a fold 30 and a fold 31. A low tack adhesive 32 (tack is a measure of the pull resistance exerted by a material adhering completely to two separating surfaces) is placed on body 29, and a high tack adhesive layer 33 covered with release paper 34 is placed on flap 28. Adhesive 32 may be the 928-100 double coated industrial tape manufactured by Minnesota Mining and Manufacturing (3M). Adhesive 33 and release paper 34 may be the ATG 465 tape, which is manufactured by 3M. It would be obvious to one skilled in the art that adhesive 32 may be applied to flap 28 and body 29 by depositing a film or coating of the adhesive.

When one wants to print on envelope 25, one folds down flap 28 along fold 30 so that adhesive 32 will hold flap 28 to body 29 of envelope 25.

Figure 2B:
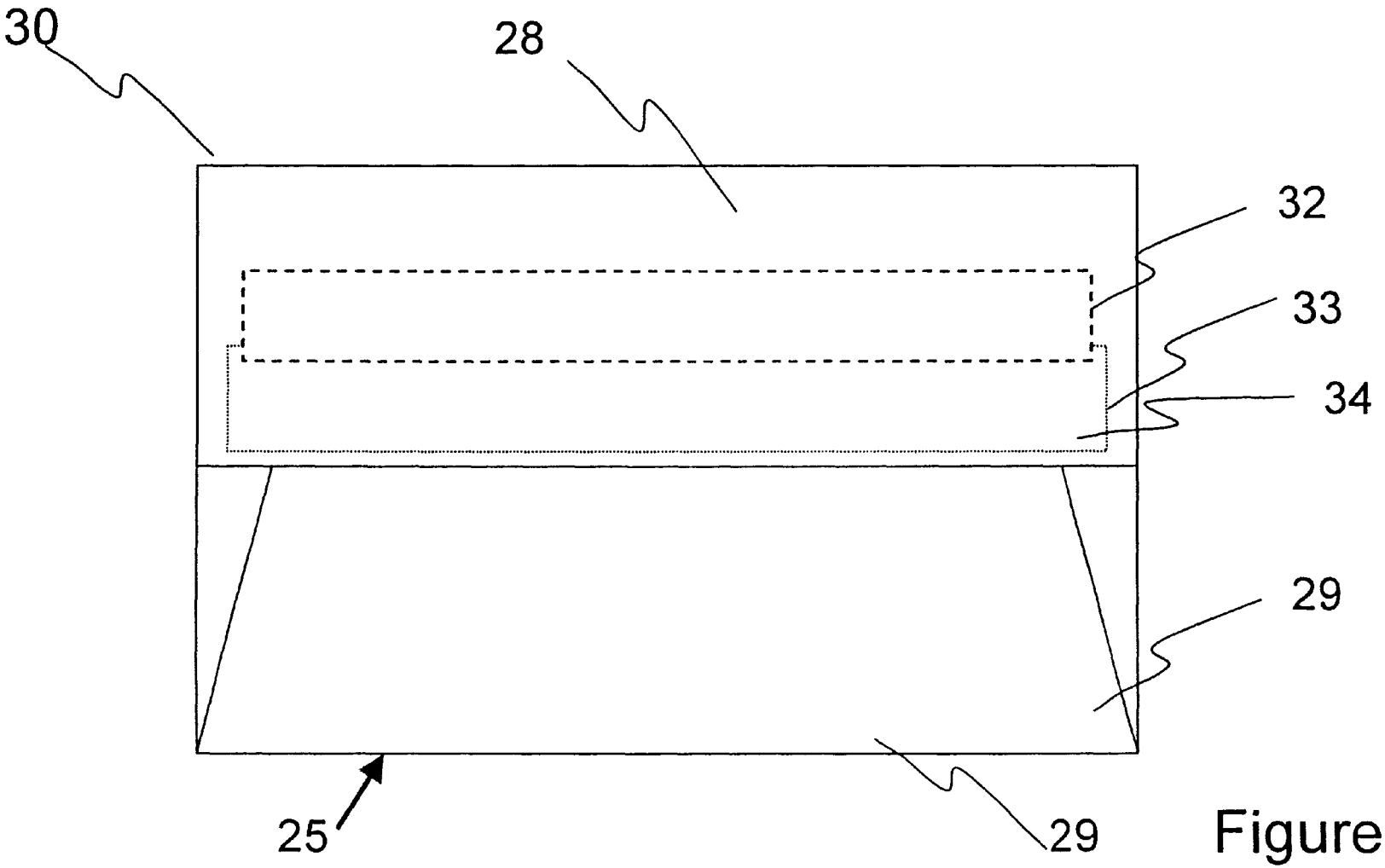
FIG. 2B is a drawing of the back of envelope 25 in a pre-printed closed configuration before the IBI indicia, recipient's and sender's addresses are printed.

FIG. 2B is a drawing of the back of envelope 25 in a pre-printed closed configuration before the IBI indicia, recipient's and sender's addresses are printed. The foregoing is the configuration in which one would purchase envelope 25. Flap 28 will be folded at fold 30, adhesive 32 will hold flap 28 against body 29 in a manner that releases paper 34, and adhesive layer 33 will be between flap 28 and body 29. The IBI indicia, recipient's and sender's addresses may be printed on the front of envelope 25 when envelope 25 is in the configuration shown in FIG. 2B.

Figure 3A:
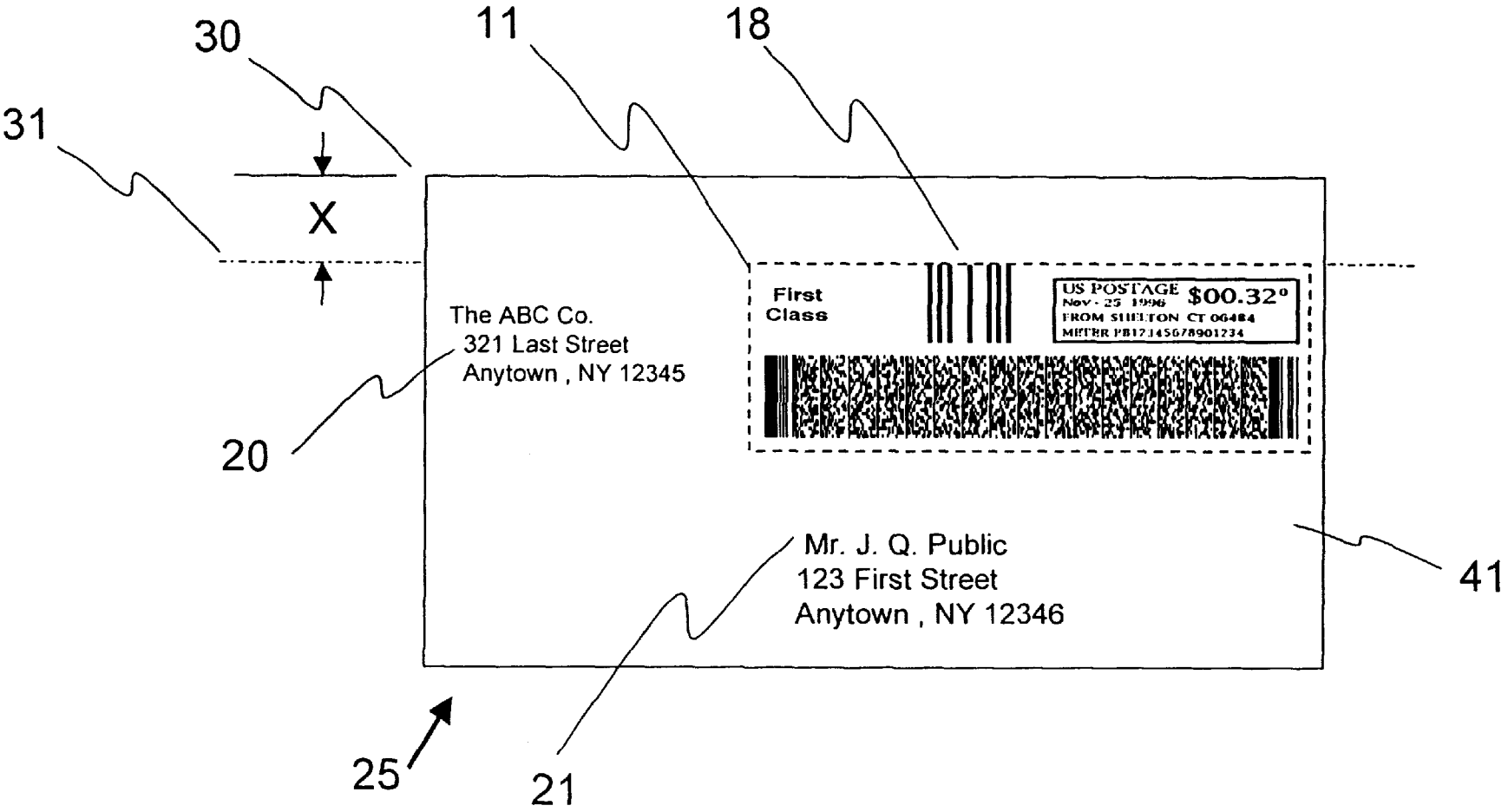
FIG. 3A is a drawing of the front of the envelope of FIG. 2B after the envelope has been printed.

FIG. 3A is a drawing of front 41 of envelope 25 of FIG. 2B after IBI indicia 11, sender address 20 and recipient address 21 have been printed on envelope 25. There is a space X between fold 30 and fold 31. FIM 18 was printed a distance X from fold 31. It would be obvious to one skilled in the art that portions of front 41 of envelope 25 may be windowed or translucent.

Figure 3B:
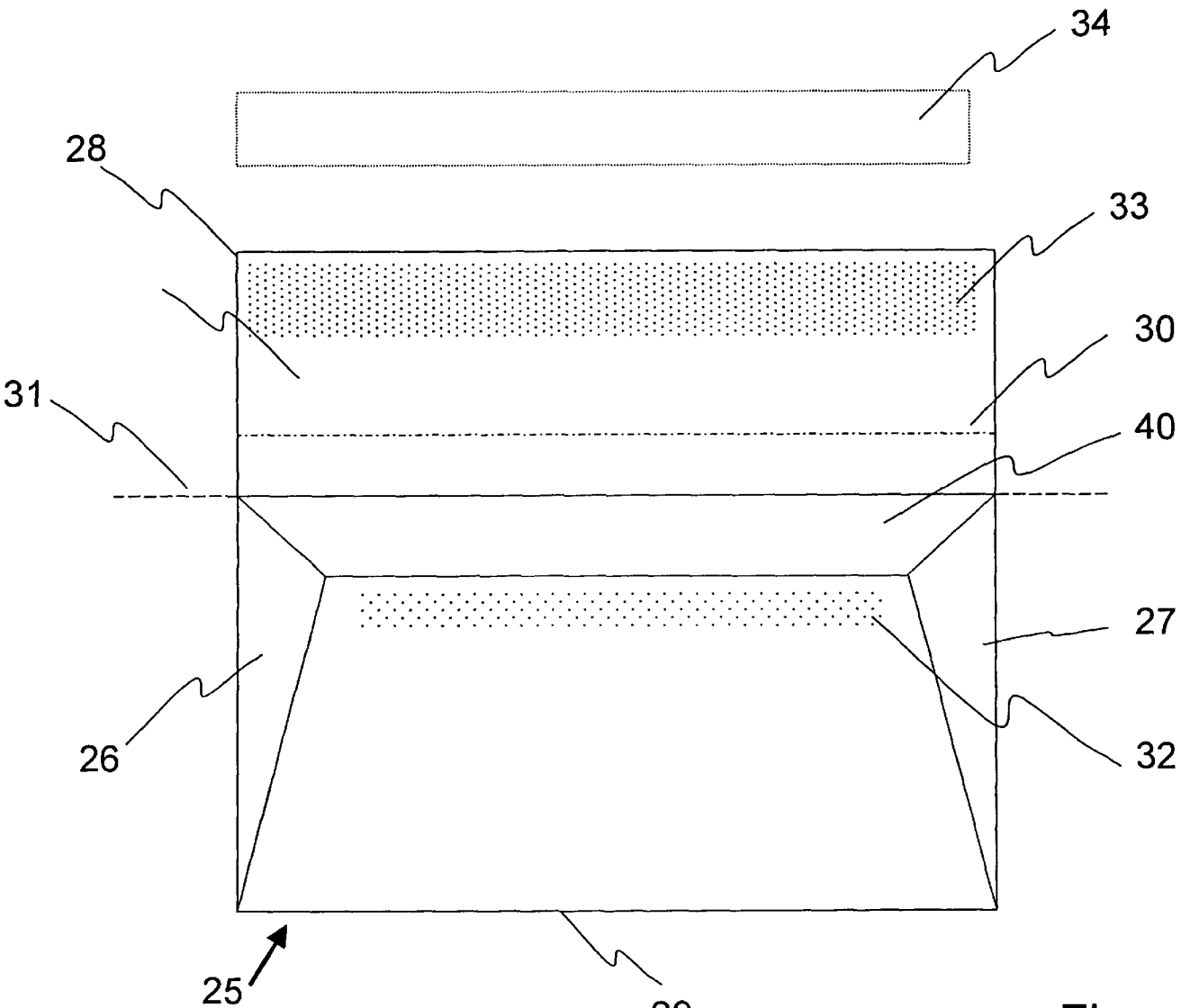
FIG. 3B is a drawing of the back of envelope 25 of FIG. 3A in an open configuration after release paper 34 has been removed and IBI indicia 11, sender's address 20 and recipient's addresses 21 have been printed on front 41 of envelope 25.

FIG. 3B is a drawing of the back of envelope 25 of FIG. 3A in an open configuration after release paper 34 has been removed, and IBI indicia 11, sender's address 20 and recipient's address 21 have been printed on front 41 of envelope 25. Flap 28 has been easily opened since it was held with a low tack adhesive (adhesive 32), and a letter or other material (not shown) has been inserted into throat 40 causing sides 26 and 27 to expand. Flap 28 may now be refolded along fold 31 in a manner that adhesive 33 will seal flap 28 to body 29.

The personal computer printers (not shown) were able to print FIM 18, IBI 11, the recipient's address 21 and the sender's address 20 without adhesive 32 on flap 28 adhering strongly to body 29 and sealing or partially sealing envelope 25, thereby potentially rendering envelope 25 useless. The reason for the foregoing is adhesive 32 is low tack and not water-based.

Figure 3C:
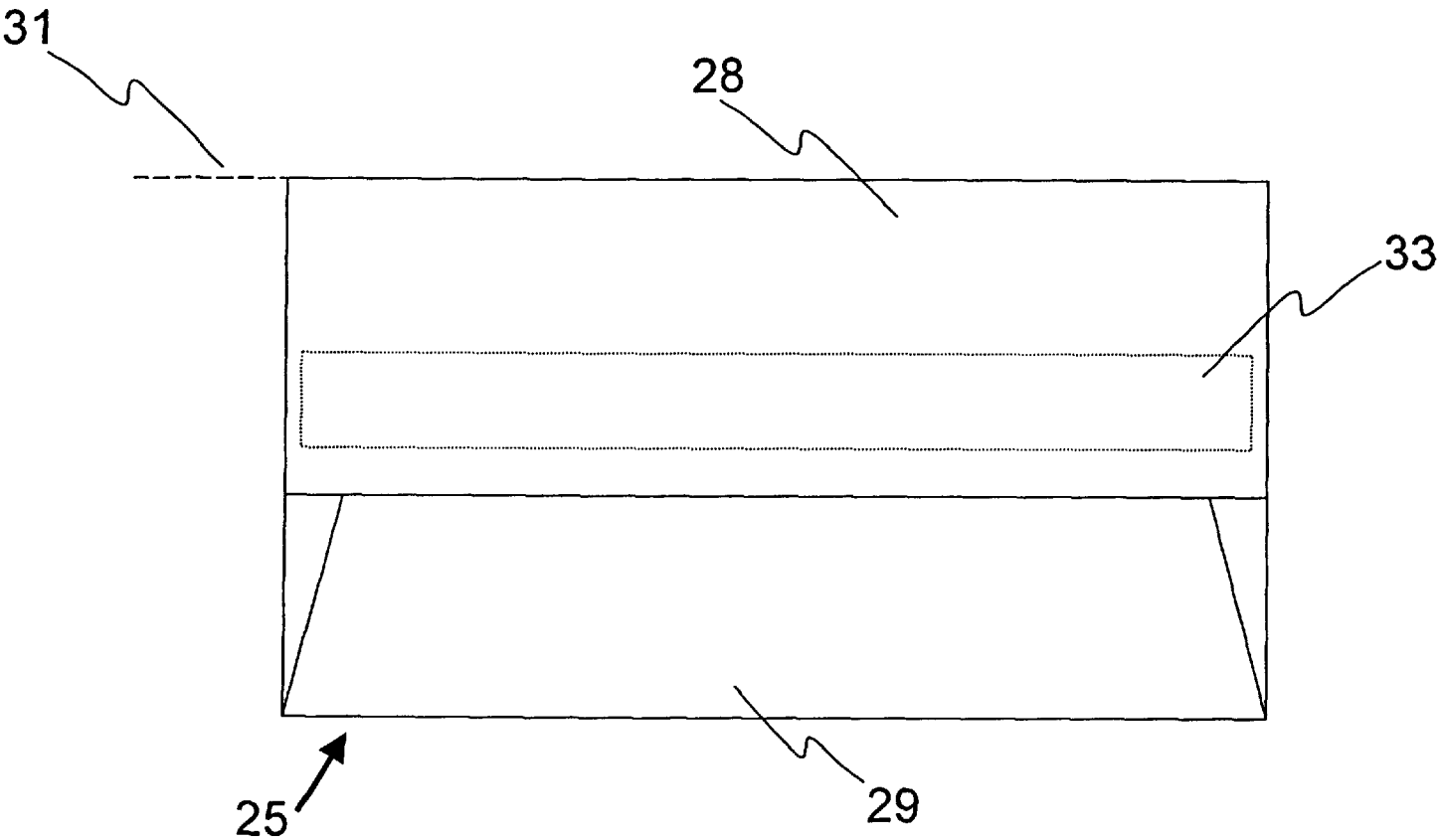
FIG. 3C is a drawing of the back of envelope 25 in a closed configuration after the IBI indicia 11, sender's address 20 and recipient's address 21 have been printed on front 41 of envelope 25, and material has been inserted into envelope 25.

FIG. 3C is a drawing of the back of envelope 25 in a closed configuration after the IBI indicia 11, sender's address 20 and recipient's address 21 have been printed on front 41 of envelope 25, and material has been inserted into envelope 25. In this configuration, flap 28 is securely attached to body 29 by adhesive 33.

Figure 3D:
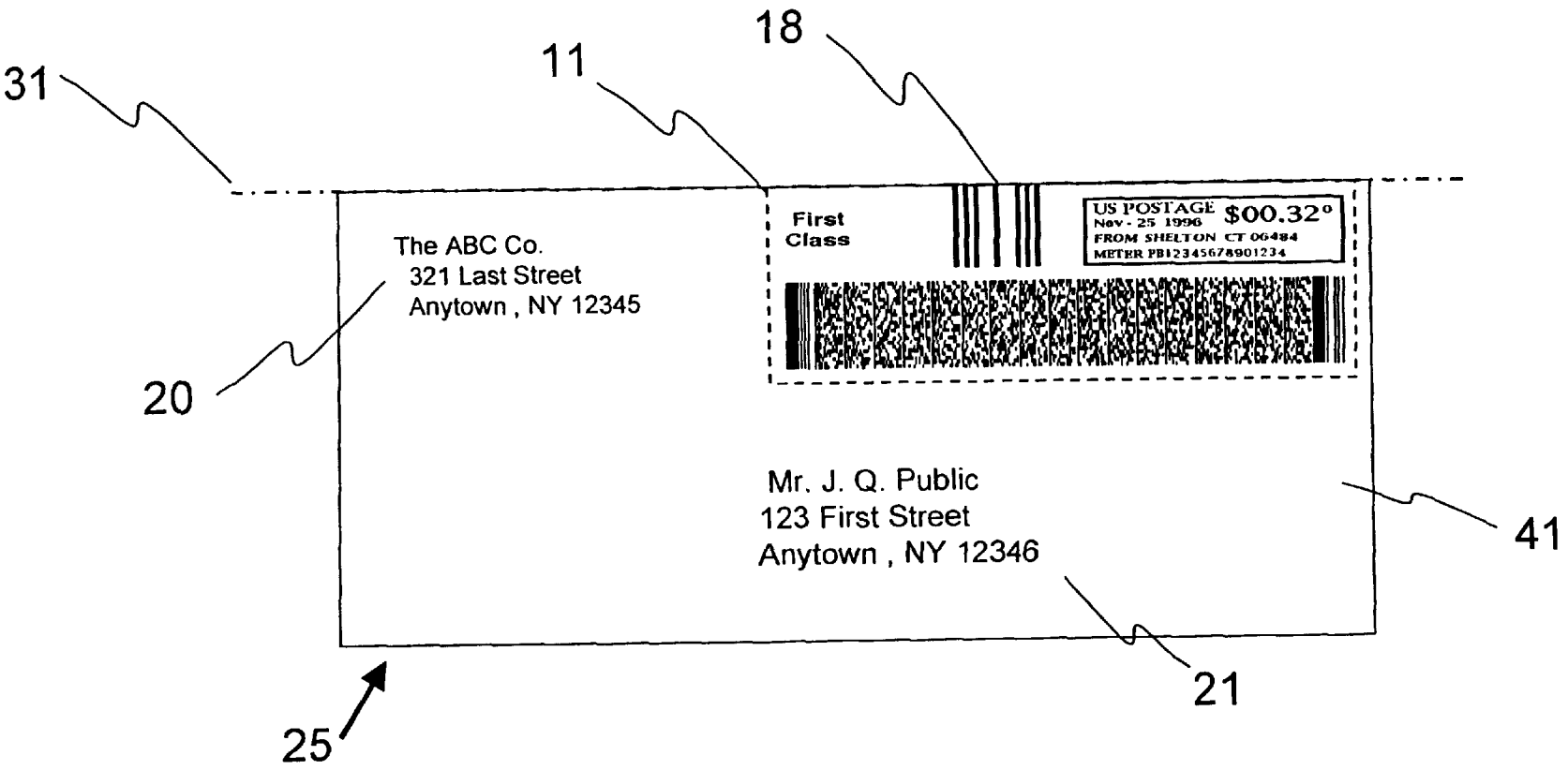
FIG. 3D is a drawing of the front of envelope 25 in a closed configuration after the IBI indicia 11, sender's address 20 and recipient's address 21 have been printed on front 41 of envelope 25, and material has been inserted into envelope 25.

FIG. 3D is a drawing of the front of envelope 25 in a closed configuration after the IBI indicia 11, sender's address 20 and recipient's address 21 have been printed on front 41 of envelope 25, and material has been inserted into envelope 25. Fold 31 will be the top edge of envelope 25 and will be flush with fold 31. Thus, FIM 18, as part of an IBI indicia 11, will be registered along the top edge of envelope 25.

The above specification describes a new and improved envelope that enables personal computer printers to be able to print a FIM as part of an IBI registered along the top edge of the envelope. It is realized that the above description may indicate to those skilled in the art additional ways in which the principles of this invention may be used without departing from the spirit. Therefore, it is intended that this invention be limited only by the scope of the appended claims.

What is claimed is:

1. A method for printing on an envelope using a computer printer to print near a edge of the envelope, the method comprising the steps of:

(a) providing a envelope having a front panel, a back panel and a closure flap having a first fold and a second fold, the closure flap being attached to the front panel, (b) folding the closure flap of envelope along the first fold;

(c) printing an IBI indicia on the front panel the envelope in the vicinity of the second fold by a computer printer; and (d) folding the closure flap of envelope along the second fold so that the FIM portion of the IBI indicia will be registered along one of the edges of the front panel.

2. The method of claim 1, wherein the step (b) further includes the step of temporarily holding the flap to the back panel.

3. The method of claim 1, wherein the step (b) further includes the step of temporarily holding the flap to the back panel with a low tack adhesive.

4. The method of claim 1, wherein the step (d) further includes the step of securing the flap to the back panel.

5. The method of claim 1, wherein the step (d) further includes the step of securing the flap to the back panel with a high tack adhesive.

* * * * *